US006634643B1

(12) United States Patent
Kern et al.

(10) Patent No.: US 6,634,643 B1
(45) Date of Patent: Oct. 21, 2003

(54) BINGO SIGNALING KIT

(76) Inventors: Marcia A. Kern, 417 Northridge, St. Louis, MO (US) 63137; Kenneth Stergion, 417 Northridge, St. Louis, MO (US) 63137

( * ) Notice: Subject to any disclaimer, the term of this patent is extended or adjusted under 35 U.S.C. 154(b) by 0 days.

(21) Appl. No.: 10/053,919

(22) Filed: Jan. 24, 2002

(51) Int. Cl.[7] ..... A63F 9/00
(52) U.S. Cl. ..... 273/269; 273/148 R; 40/658
(58) Field of Search ..... 40/124.02, 124.08, 40/658, 647, 648, 659; 273/269, 270, 148 R

(56) References Cited

U.S. PATENT DOCUMENTS 2,563,693 A * 8/1951 Russell ..... 340/321
4,250,491 A * 2/1981 Dotson ..... 340/321
5,124,683 A * 6/1992 Brunner ..... 340/323 R
5,358,246 A * 10/1994 Dziedzic ..... 273/148 A
5,655,772 A * 8/1997 Muelver ..... 273/148 A
5,786,758 A * 7/1998 Bullock ..... 340/539
6,014,942 A * 1/2000 Perka et al. ..... 116/309
6,380,863 B1 * 4/2002 Swoboda et al. ..... 340/815.4
6,390,017 B1 * 5/2002 Hendrickson et al. ..... 116/317

* cited by examiner

*Primary Examiner*—William M. Pierce

(57) ABSTRACT

A bingo signaling kit for notifying the number caller for the bingo game that the user has gotten bingo. The bingo signaling kit includes a support assembly including at least one housing member each having top, side and bottom walls, and each also having one or more openings being disposed through the top wall; and also includes signal assemblies each being disposed in at least one housing member and also being extendable through one or more openings; and further includes an assembly for raising and extending the signal assemblies through the one or more openings.

2 Claims, 4 Drawing Sheets

BINGO SIGNALING KIT

BACKGROUND OF THE INVENTION

1. Field of the Invention

The present invention relates to bingo signaling accessories and more particularly pertains to a new bingo signaling kit for notifying the number caller for the bingo game that the user has gotten bingo.

2. Description of the Prior Art

The use of bingo signaling accessories is known in the prior art. More specifically, bingo signaling accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,358,246; U.S. Pat. No. 5,655,772; U.S. Pat. No. 4,572,510; U.S. Pat. No. 3,775,887; U.S. Pat. No. 5,813,445; and U.S. Pat. No. Des. 412,863.

While these devices fulfill their respective, particular objectives and requirements, the aforementioned patents do not disclose a new bingo signaling kit. The inventive device includes a support assembly including at least one housing member each having top, side and bottom walls, and each also having one or more openings being disposed through the top wall; and also includes signal assemblies each being disposed in the at least one housing member and also being extendable through the one or more openings; and further includes an assembly for raising and extending the signal assemblies through the one or more openings; features not described nor suggested in the prior art.

In these respects, the bingo signaling kit according to the present invention substantially departs from the conventional concepts and designs of the prior art, and in so doing provides an apparatus primarily developed for the purpose of notifying the number caller for the bingo game that the user has gotten bingo.

SUMMARY OF THE INVENTION

The general purpose of the present invention, which will be described subsequently in greater detail, is to provide a new bingo signaling kit which has many of the advantages of the bingo signaling accessories mentioned heretofore and many novel features that result in a new bingo signaling kit which is not anticipated, rendered obvious, suggested, or even implied by any of the prior art bingo signaling accessories, either alone or in any combination thereof.

There has thus been outlined, rather broadly, the more important features of the bingo signaling kit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new bingo signaling kit which has many of the advantages of the bingo signaling accessories mentioned heretofore and many novel features that result in a new bingo signaling kit which is not anticipated, rendered obvious, suggested, or even implied by any of the prior art bingo signaling accessories, either alone or in any combination thereof.

Still another object of the present invention is to provide a new bingo signaling kit for notifying the number caller for the bingo game that the user has gotten bingo.

Still yet another object of the present invention is to provide a new bingo signaling kit that is easy and convenient to use.

Even still another object of the present invention is to provide a new bingo signaling kit that allows the user to more carefully concentrate on the game and the cards one is playing.

These together with other objects of the invention, along with he various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
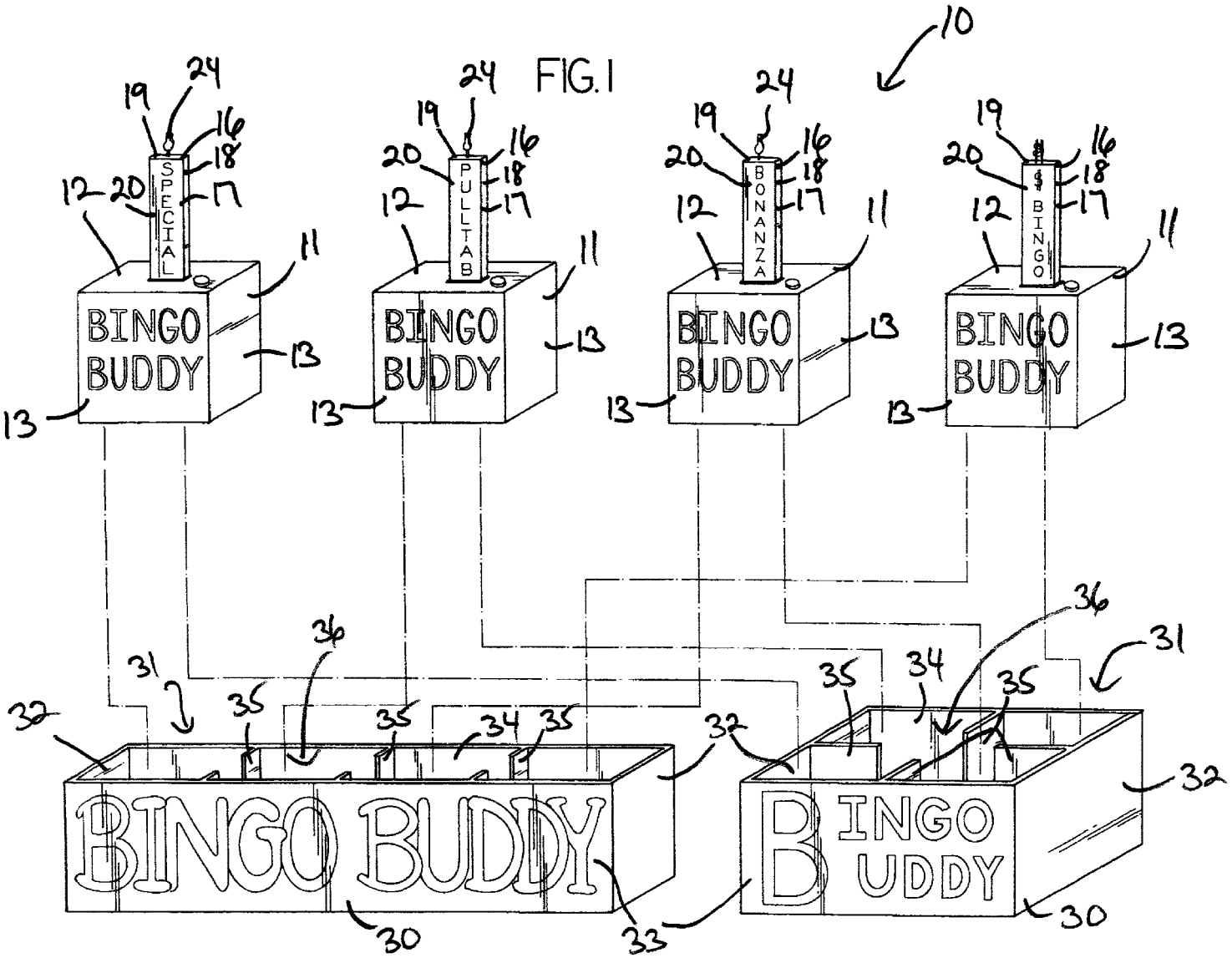
FIG. 1 is an exploded perspective view of a new bingo signaling kit according to the present invention.
Figure 2:
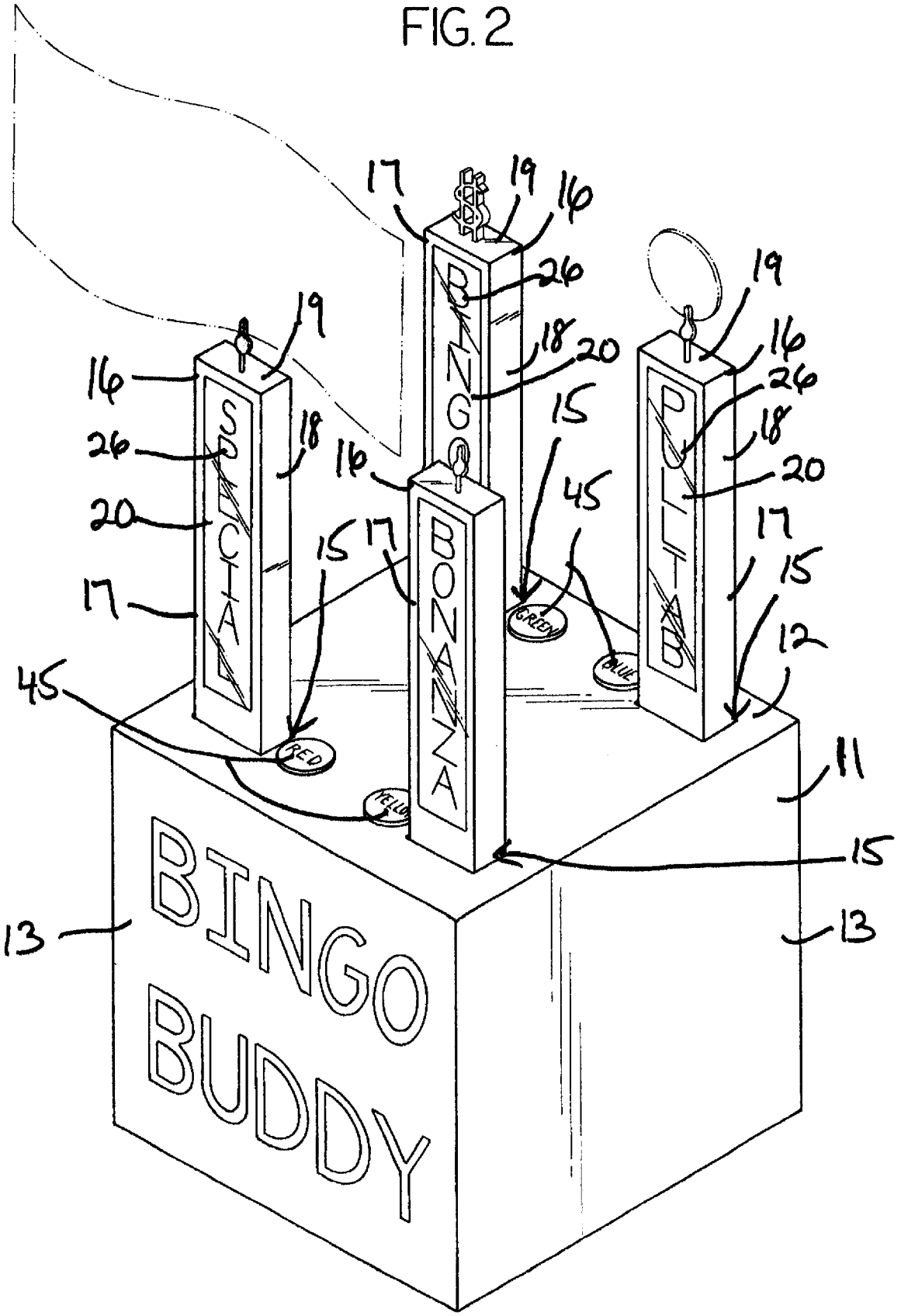
FIG. 2 is a perspective view of a second embodiment of the present invention.
Figure 4:
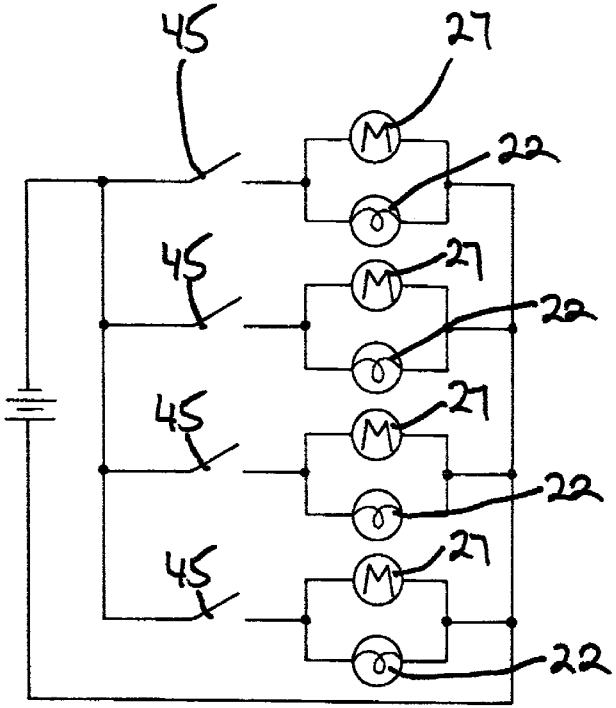
FIG. 4 is a schematic diagram of the present invention.
Figure 3:
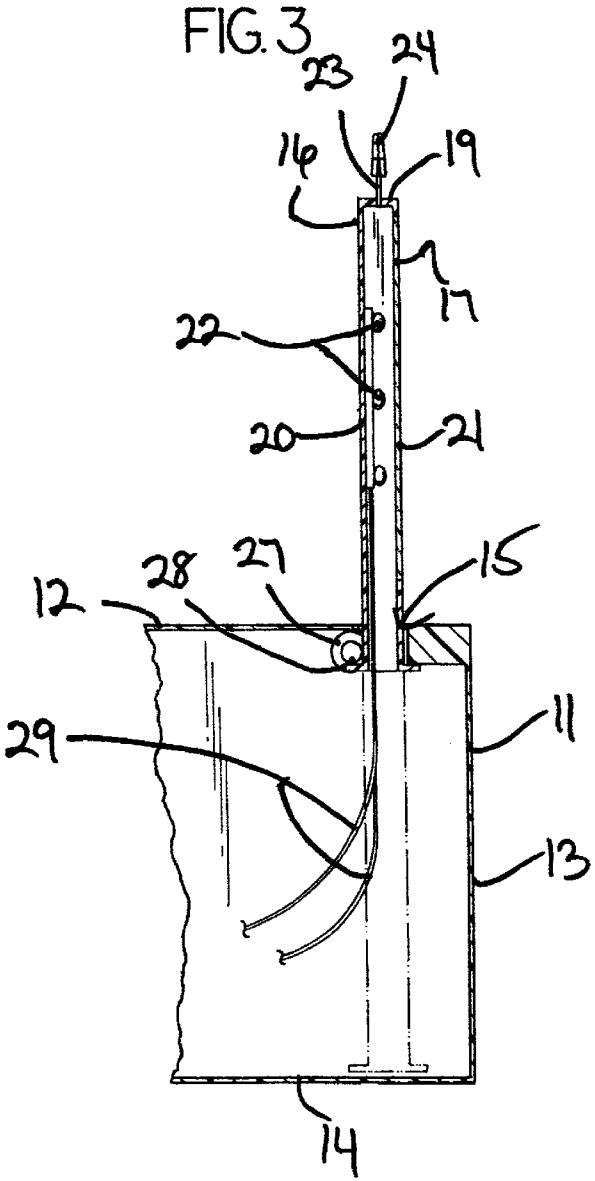
FIG. 3 is a cross-sectional view of the present invention.
Figure 5:
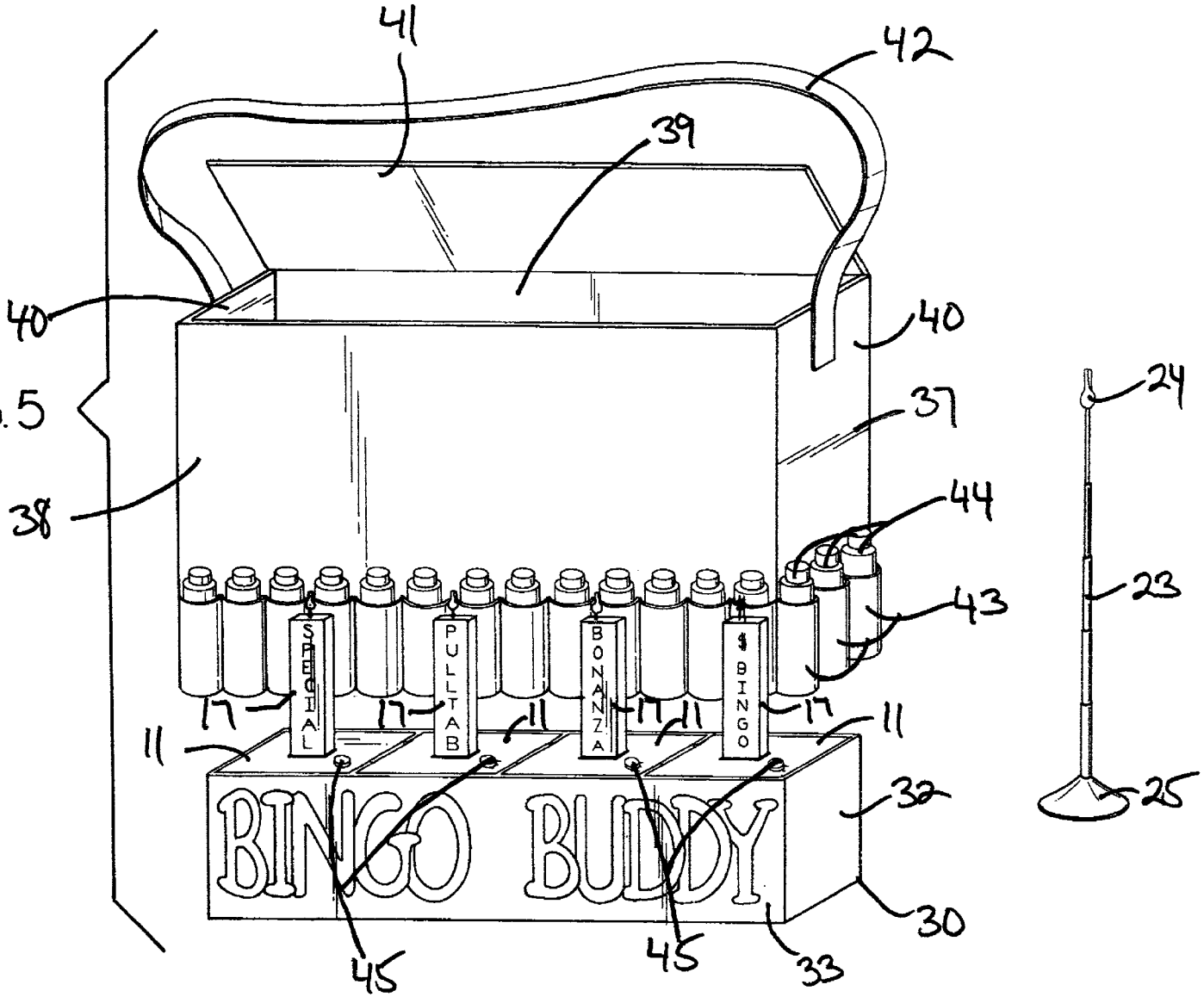
FIG. 5 is perspective view of the present invention.

With reference now to the drawings, and in particular to FIGS. 1 through 5 thereof, a new bingo signaling kit embodying the principles and concepts of the present invention and generally designated by the reference numeral 10 will be described.

As best illustrated in FIGS. 1 through 5, the bingo signaling kit 10 generally comprises a support assembly including at least one housing member 11 each having top, side and bottom walls 12–14, and each also having one or more openings 15 being disposed through the top wall 12. Signal assemblies with one or more being conventionally disposed in the at least one housing member 11 and also being extendable through the one or more openings 15. Each of the signal assemblies includes a sign member 16 having a thin, elongate housing 17 with side and end walls 18,19, and also with transparent front and back walls 20,21; and also includes light-emitting members 22 being conventionally disposed in the sign member 16 and being adapted to be connected to a power source with wires 29. Each the signal assemblies further includes a holder assembly 23–25 being conventionally attached to the end wall 19 of a respective sign member 16 and including a support member 23 and a clip member 24 being conventionally supported upon the support member 23. The holder assembly 23–25 further includes the support member 23 being telescopic having a plurality of tubular sections, and also includes a suction cup 25 being conventionally attached to a bottom end of the support member 23 and being attached to a respective the end wall 19. The transparent front and back walls 20,21 have selected words 26 being conventionally displayed thereupon.

A means for raising and extending the signal assemblies through the one or more openings 15 includes motors 27 each of which is conventionally disposed in the at least one housing member 11 and is adapted to be connected with wires 29 to the power source, and also includes wheels 28 each of which is rotatably and conventionally mounted to a respective motor 27 and is engagable to a respective sign member 16 for moving the sign member 16 outwardly of the at least one housing member 11, and further includes switch members 45 each of which is depressibly and conventionally disposed in the top wall 12 of the at least one housing member 11 and is connected to a respective motor 27 and is adapted to be connected to the power source.

As a first embodiment, the at least one housing member 11 includes one housing member 11 having a plurality of the openings 15 being disposed through the top wall 12 thereof with the sign members 16 being extendable through the plurality of the openings 15.

As a second embodiment, the at least one housing member 11 includes a plurality of housing members 11 each having one opening 15 being disposed through the top wall 12 thereof. The support assembly further includes a rack 30 having an open top 31 and also having side, front, back walls 32–34, and further having a plurality of partitions 35 being spacedly and conventionally disposed between the front and back walls 33,34 to form storage compartments 36 for the housing members 11.

The support assembly also includes a carrying case having a container 37 with front, side, and back walls 38–40 and an open top, and also having a cover 41 for closing the open top of the container 37, and further having a carrying strap 42 being conventionally attached to the container 37 for carrying the carrying case, and also having a plurality of pockets 43 being conventionally attached side-by-side to an exterior of the container 37 and being adapted to hold bingo dabbers 44 therein with each of the pockets 43 having an arcuate front wall, and an open top.

In use, the user would take the one or more housing members 11 to the bingo game and would position the one or more housing members 11 upon the table. Upon getting bingo for a particular game, the user depresses the switch member 45 to energize the motor 27 which actuates the wheel 28 which moves the selected sign member 16 outwardly of the particular opening 15 of the housing member 11 with the light-emitting members 22 being energized to light up the sign member 16 with the word "BINGO" being lit up and displayed from the sign member 16. Once finished, the user simply lowers the sign member 16 back into the housing member 11. The user may also have other display signs 16 which indicate a particular game and would depress the particular switch member 45 to extend that particular sign member 16 from the housing member 11. In addition, the user could place the required dollar bills for the particular game in the clip member 24 so the attendant for the game could pick up the money without interfering with the user's concentration on the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the bingo signaling kit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bingo signaling kit comprising:

a support assembly including at least one housing member each having top side and bottom walls, and each also having one or more openings being disposed through said top wall thereof;

signal assemblies one or more of which are being disposed in said at least one housing member and are also being extendable through said one or more openings, each of said signal assemblies including a sign member having a thin, elongate housing with side and top walls, and also with transparent front and back walls; and also including light-emitting members being disposed in said sign member and being adapted to be connected to a power source with wires, each said signal assembly further including a holder assembly being attached to said top wall of a respective said sign member and including a support member and a clip member being supported upon said support member, said signal assembly further including said support member being telescopic and having a plurality of tubular sections, and also including a suction cup being attached to a bottom end of said support member and being attached to a respective said top wall of said sign member; and a means for raising and extending said signal assemblies through said one or more openings.

2. A bingo signaling kit comprising:

a support assembly including at least one housing member each having top, side and bottom walls, and each also having one or more openings being disposed through said top wall thereof, said at least one housing member including one housing member having a plurality of said openings being disposed through said top wall thereof, said sign members being extendable through said plurality of said openings;

signal assemblies one or more of which are being disposed in said at least one housing member and are also being extendable through said one or more openings, each of said signal assemblies includes a sign member having a thin, elongate housing with side and top walls, and also with transparent front and back walls; and also includes light-emitting members being disposed in said sign member and being adapted to be connected to a power source with wires, said transparent front and back walls have selected words displayed thereupon; and a means for raising and extending said signal assemblies through said one or more openings.

* * * * *